United States Patent [19]

Yamada et al.

[11] Patent Number: 4,495,638

[45] Date of Patent: Jan. 22, 1985

[54] AUDIO-BAND ELECTRO-MECHANICAL VIBRATION CONVERTER

[75] Inventors: Kyota Yamada; Akira Komatsu, both of Tokyo, Japan

[73] Assignee: Body Sonic Kabushiki Kaisha, Tokyo, Japan

[21] Appl. No.: 351,555

[22] Filed: Feb. 23, 1981

Related U.S. Application Data

[62] Division of Ser. No. 025,501, Mar. 30, 1979, Pat. No. 4,354,067.

[30] Foreign Application Priority Data

| | | | |
|---|---|---|---|
| May 17, 1978 | [JP] | Japan | 53-58518 |
| May 31, 1978 | [JP] | Japan | 53-65486 |
| May 31, 1978 | [JP] | Japan | 53-65487 |
| May 31, 1978 | [JP] | Japan | 53-65488 |
| Jun. 22, 1978 | [JP] | Japan | 53-75580 |
| Jul. 27, 1978 | [JP] | Japan | 53-103285[U] |
| Jul. 27, 1978 | [JP] | Japan | 53-103286[U] |
| Aug. 7, 1978 | [JP] | Japan | 53-96014 |
| Oct. 5, 1978 | [JP] | Japan | 53-137134[U] |
| Nov. 20, 1978 | [JP] | Japan | 53-159887[U] |
| Dec. 26, 1978 | [JP] | Japan | 53-181743[U] |

[51] Int. Cl.[3] ..... H04R 5/00

[52] U.S. Cl. ..... 381/27; 381/24

[58] Field of Search ..... 307/529, 540, 543, 546, 307/555, 556; 328/169; 329/134; 381/1-4, 7, 13, 24, 25, 27, 28

[56] References Cited

U.S. PATENT DOCUMENTS

| | | | |
|---|---|---|---|
| 2,284,444 | 5/1942 | Peterson | 329/134 X |
| 2,420,248 | 5/1947 | Koch | 328/169 X |
| 2,835,803 | 5/1958 | Bose | 329/134 X |
| 3,135,830 | 6/1964 | Starat | 179/1 G |
| 3,193,771 | 7/1965 | Boatwright | 329/134 |
| 3,277,384 | 10/1966 | Loughlin | 329/134 |
| 3,320,738 | 5/1967 | Sparing et al. | 310/15 |
| 3,449,531 | 6/1969 | Ashworth | 179/181 W |
| 3,553,392 | 1/1971 | Liebscher | 179/115.5 R |
| 3,567,870 | 3/1971 | Rivera | 179/181 W |
| 3,636,281 | 1/1972 | Cozart | 179/181 W |
| 3,728,497 | 4/1973 | Komatsu | 179/181 W |
| 4,064,376 | 12/1977 | Yamada | 179/146 H |
| 4,176,249 | 11/1979 | Inanaga et al. | 179/115.5 DV |

FOREIGN PATENT DOCUMENTS

| | | | |
|---|---|---|---|
| 2132018 | 1/1972 | Fed. Rep. of Germany . | |
| 2745002 | 7/1978 | Fed. Rep. of Germany | 128/33 |
| 1304736 | 8/1962 | France | 128/33 |
| 445522 | 2/1949 | Italy | 179/107 BC |
| 293337 | 6/1928 | United Kingdom . | |
| 562071 | 6/1944 | United Kingdom . | |
| 613198 | 11/1948 | United Kingdom . | |
| 620301 | 3/1949 | United Kingdom . | |
| 791928 | 3/1958 | United Kingdom . | |
| 884338 | 12/1961 | United Kingdom . | |
| 900901 | 7/1962 | United Kingdom . | |
| 924499 | 4/1963 | United Kingdom . | |
| 1050387 | 12/1966 | United Kingdom . | |
| 1123524 | 8/1968 | United Kingdom . | |
| 1258385 | 12/1971 | United Kingdom . | |
| 1426089 | 2/1976 | United Kingdom . | |
| 1447588 | 8/1976 | United Kingdom . | |
| 1456673 | 11/1976 | United Kingdom . | |
| 1508348 | 4/1978 | United Kingdom . | |
| 1510154 | 5/1978 | United Kingdom . | |
| 1516256 | 6/1978 | United Kingdom . | |
| 1512783 | 6/1978 | United Kingdom . | |

*Primary Examiner*—Stafford D. Schreyer
*Assistant Examiner*—W. J. Brady
*Attorney, Agent, or Firm*—James C. Wray

[57] ABSTRACT

A device for giving an audio signal to a coil associated with an audio-band electromechanical converter uses a mixer, a first-stage low-pass filter, a limited and a second-stage low pass filter to correct distortion of the wave form of a signal from the limiter.

3 Claims, 9 Drawing Figures

AUDIO-BAND ELECTRO-MECHANICAL VIBRATION CONVERTER

This application is a division of application Ser. No. 025,501, filed Mar. 30, 1979 now U.S. Pat. No. 4,354,067, Oct. 12, 1982.

BACKGROUND OF THE INVENTION

The present invention relates to an audio-band electromechanical vibration converter in which a low-band electric signal causes a body-felt vibration and thereby makes it possible to appreciate double bass sound through ear drum vibration and body-felt vibration.

The lower the frequency of sound is below 150 Hz, the greater will be the proportion of sound which is felt not only as a vibration of ear drum but also as a sound pressure, i.e., air vibration felt by the body. The so-called double bass sound is felt as an air vibration which must be appreciated not only through the ear but also through the skin or body; a true appreciation of double bass sound is possible only when audio sensation is coupled with body sensation.

For ideal appreciation of double bass sound, an attempt has been made at causing a body-felt vibration synchronized with an electric signal to drive the speaker.

For instance, U.S. Pat. No. 3,366,749 discloses an audio-band electromechanical vibration converter to cause a body-felt vibration, in which a gap is formed by a yoke with a magnetic pole; a frame-wound coil is set in said gap; and a vibration is caused through magnetic interference between the magnetic force developed in said coil by an electric signal and the magnetic force of said magnetic pole. In this case a screw stem is erected on the coil frame and the coil frame is supported through a damper on the yoke in such a manner that said coil frame and said yoke can be displaced relative to each other. Thereby, since the coil frame is supported at a position deviated from the gap in which the coil is set, the coil set in the gap after fitted to the vibration plate by said screw stem is liable to be shifted in position under the load of said yoke, resulting in a failure to cause an effective vibration. It is conceivable to make the damper rigid enough to stand the load of the yoke so that the coil may be properly positioned in the gap, at whatever angle the casing is attached; in that case, however, it would be impossible to cause a satisfactory vibration of double bass. On the contrary, if the damper were made soft enough to cause a satisfactory vibration of double bass, the coil would not be properly positioned in the gap on account of the load of the yoke, thereby making the action unstable.

Moreover, since the coil frame is attached to the vibration plate by means of said screw stem erected thereon, with the thickness increased, the whole assembly becomes inevitably bulky.

In the case of a converter being attached to a vibration plate embedded in a chair from the backside of said chair, as disclosed in U.S. Pat. No. 3,366,749, said converter may be employed without any trouble, but in this case it will be necessary to modify the whole structure of the chair. If an assembly of such a converter attached to an independent vibration plate without modification of chair structure is applied to a chair, the thickness will be increased and the user of the chair will feel discomfort.

The present invention, free from the above-mentioned troubles, is characterized in that a yoke having a permanent magnet and a magnetic gap is displaceably set through a damper in a casing and said casing can produce a mechanical vibration synchronized with a low-band audio signal, without increasing the thickness of the whole assembly.

SUMMARY OF THE INVENTION

The first object of the present invention is to provide a device in which a yoke having a permanent magnet and a magnetic gap is displaceably set through a damper in a casing; said casing produces a mechanical vibration; and said casing serves as a fitting member for the vibration plate, thereby the thickness of the whole assembly not being increased.

The second object of the present invention is to provide a device in which the yoke is supported such that the coil position in the magnetic gap may not change.

The third object of the present invention is to provide a device which can be embedded in the vibration plate.

The fourth object of the present invention is to provide a device which can produce a mechanical vibration synchronized with a low-band audio signal in an audio-band electromechanical vibration converter.

The fifth object of the present invention is to provide a device which can transmit a body-felt vibration to a commercially available chair and the like without spoiling the sitting comfort.

Several other objects of the present invention will become apparent from a detailed account of its embodiments with reference to the attached drawings, in which.

Figure 2:
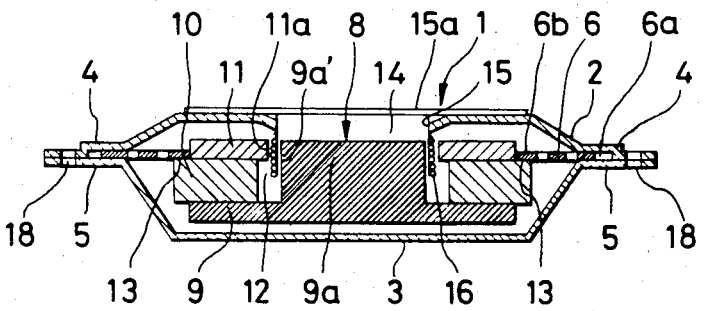
FIG. 2 is a II—II section view of FIG. 1.

FIGS. 3~6 are similar views to FIG. 2 of other embodiments of the present invention.

Figure 7:
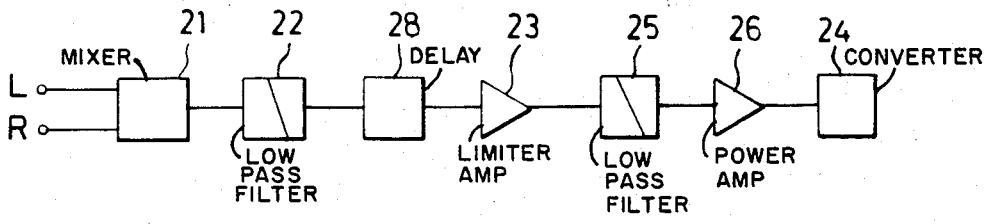
Figure 9:
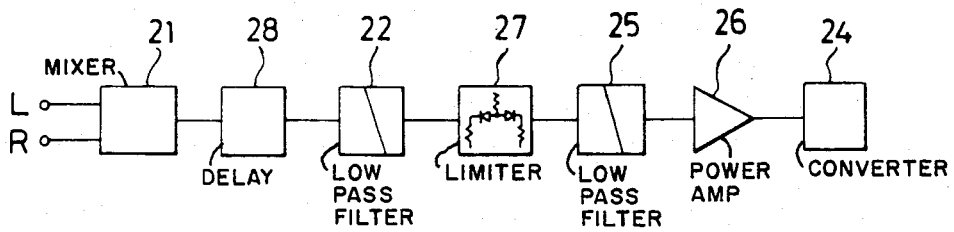

FIGS. 7 and 9 are block diagrams showing a device to drive the electromechanical vibration converter according to the present invention.

Figure 8:
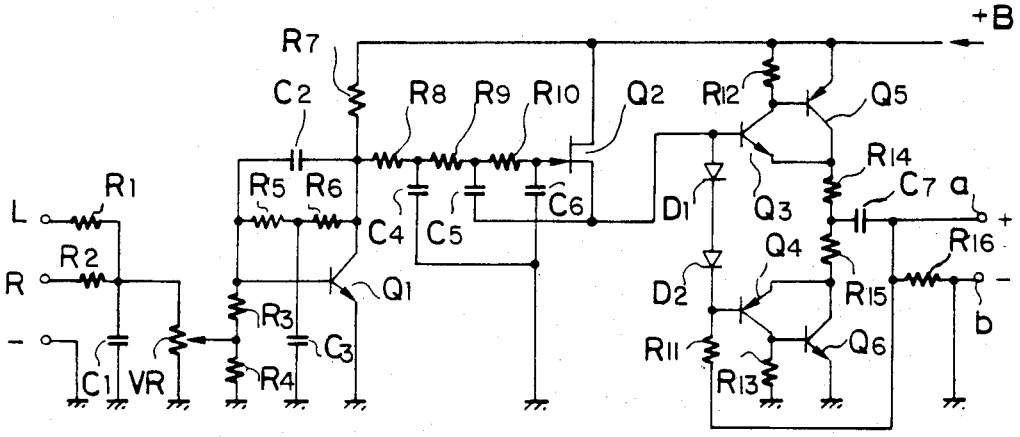

FIG. 8 shows an electric circuit embodying the block diagram of FIG. 7.

Figure 1:
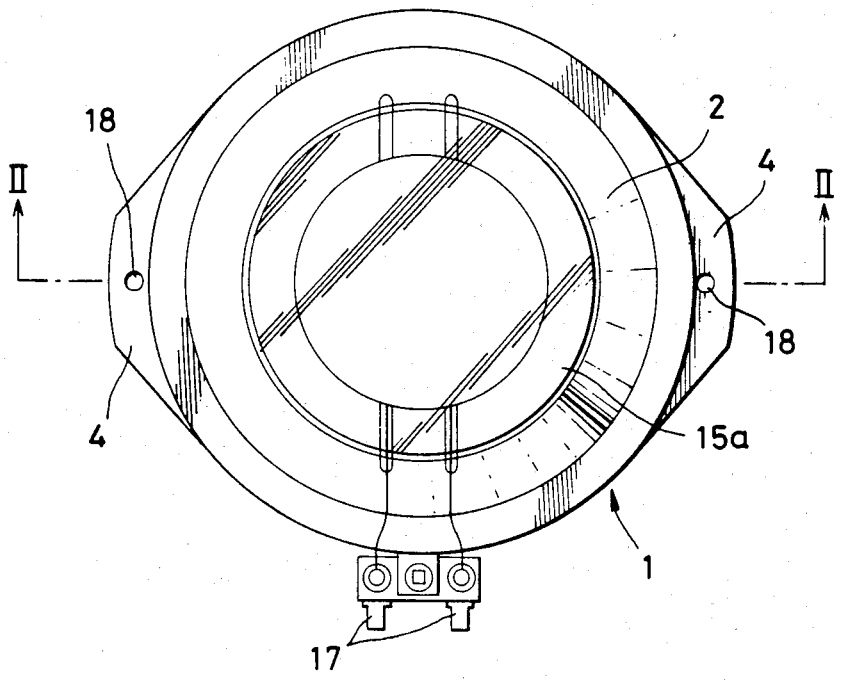
FIG. 1 is a plan view of the electromechanical vibration converter according to the present invention.

In FIGS. 1 and 2, the casing 1 of the electromechanical vibration converter consists of flat frames 2, 3 with a dish-like section. Flanged plates 4, 5 extending horizontally are integrated to the open peripheral edges of said frames 2, 3. Said frames 2 and 3 are assembled together with their open edges opposed to each other and flanges 4, 5 opposed to each other.

Between the flanges 4, 5 of said frames 2, 3 is squeezed the outer edge 6*a* of an annular damper 6 made of elastic material, the inner edge 6*b* of said damper 6 extending in the opposite direction to the flanges 4, 5, i.e., in horizontal direction into the frames 2, 3.

Next, a yoke with a permanent magnet 10, which is to be set in the casing 1, is to be described. The yoke 8 consists of a bottom plate 9 with a central pillar 9*a* and an annular top plate 11. The permanent magnet 10 is located between the bottom plate 9 and the top plate 11 and is attached thereto and is located in space relation to pillar 9A. A magnetic annular gap 12 is formed between inner edge 11*a* of said top plate 11 and outer edge 9*a*' of the pillar 9*a* of the bottom plate 9. A magnetic circuit with a magnetic gap 12 is constituted of the bottom plate 9, the permanent magnet 10 and the top plate 11. The inner edge 6*b* of the damper 6 is integrated to the stepped part 13 formed by the outer edge of the top plate 11 and the end of the permanent magnet 10 and said damper 6 permits relative displacement between the casing 1 and the yoke 8, so that the yoke 8 can be supported on a plane containing the gap 12 in the casing 1.

In the present embodiment, the damper 6 is integrated to the stepped part 13 formed by the top plate 11 and the permanent magnet 10 so that the yoke 8 can be supported on a plane containing the gap 12 in the casing 1, but the arrangement is not restricted to this one. Any arrangement will do, so long as the damper 6 is located within a plane containing the gap 12, and its outer edge 6a can be fastened to the casing 1 and its inner edge 6b can be fastened to the yoke 8. The most desirable arrangement will be such that the yoke 8 is supported by the damper 6 in the casing 1 at a position in a plane containing the gap 12, said plane being orthogonal to the axis of the gap 12 (extending vertically in FIG. 2) and passing through the center of thickness of the gap 12 in vertical direction in FIG. 2.

At the center of said frame 2 there is formed an opening 14, into which a tubular coil frame 15 attached to the plate 15a fits. Said coil frame 15 and plate 15a are integrated to the frame 2, and the coil 16 wound on the coil frame 15 is set in the gap 12.

17 denotes terminals connected to the coil 16. 18 denotes a screw hole for fitting the casing 1 to a vibration plate (not shown) placed within a cushion or the like.

An audio-band electromechanical vibration converter thus constituted can be fitted by means of the flanges 4, 5 to a vibration plate built into a chair or a cushion. When an electric signal to drive the speaker of an audio device is given via a low-pass filter to the coil 16, a magnetic interaction developed between the magnetic force generated in the coil 16 and the magnetic force of the magnetic gap 12 causes a body-felt vibration through relative displacement between the yoke 8 supported through the damper 6 in the casing 1 and the casing 1 and this vibration is transmitted via the frames 2, 3 to the vibration plate. Thereby the body-felt vibration is produced by a reproduced electric signal and accordingly it is synchronized with the audio signal which is recognized by the ear; and since it is based on a low-band electric signal, it is effective as a vibration for recognizing double bass sound. A more desirable vibration effect will be gained by changing the material quality of thickness of the damper 6. The cut-off frequency of the low-pass filter, though it depends on the sound source, is desirably 150 Hz or thereabout.

Figure 3:
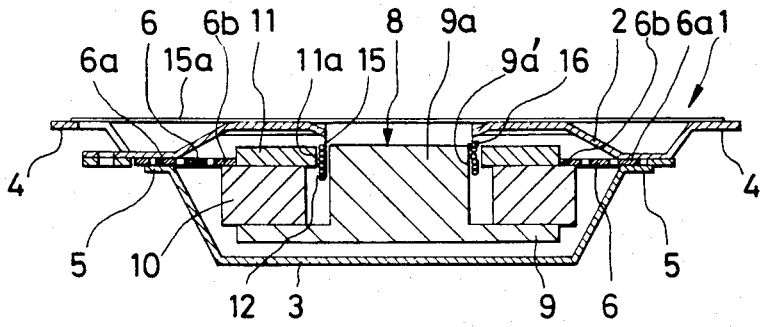
Figure 4:
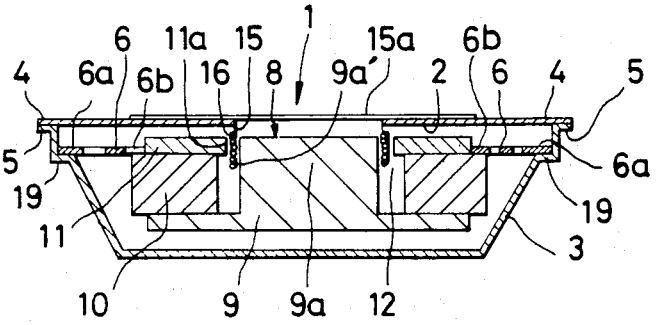
Figure 5:
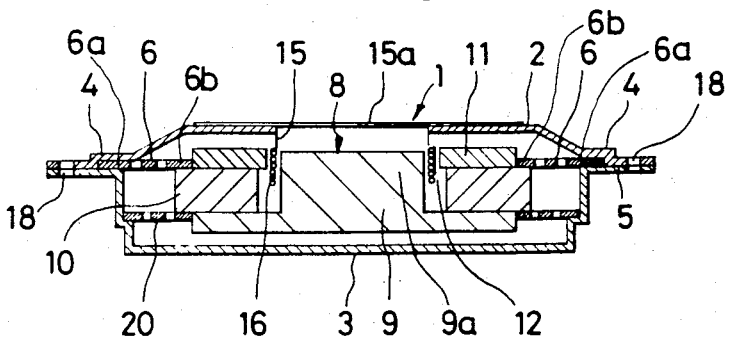
Figure 6:
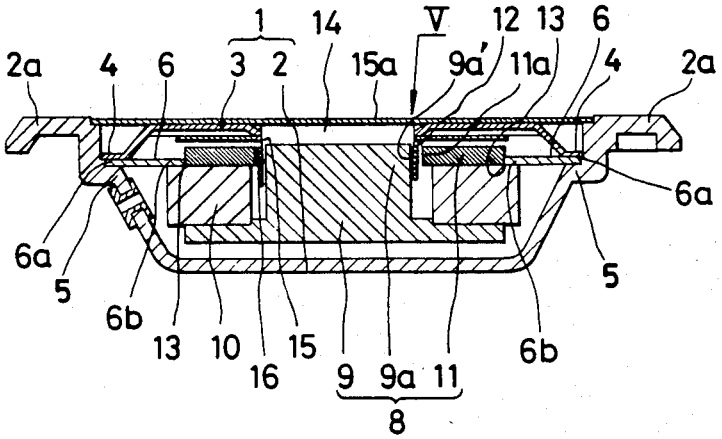

In the present example the frame 2 which constitutes the casing 1 is designed dish-like in section with flanges provided at its open edge; but as indicated in FIG. 3, it may be designed such that the open edge of the frame 2 is extended off the damper 6 to make it a flange 4 and by means of this flange 4 the casing 1 is attached to a vibration plate (not shown). The attachment of the casing 1 to the vibration plate may be direct or indirect through another member which effectively transmits the vibration. In the present example the damper 6 with its outer edge 6a held between the flanges 4, 5 is attached to the casing 1; but as indicated in FIG. 4, it may be designed such that a stepped part 19 is formed on the frame 3 and the damper 6 with its outer edge 6a fixed to this stepped part 19 is attached to the casing 1. Also in the present example, a single damper 6 located within a plane containing the gap 12 supports the yoke 8 in the casing 1; but as indicated in FIG. 5, it may be designed such that another damper 20 is added at the yoke 8 and the yoke 8 is supported in the casing 1 by the dampers 6 and 20. If the two dampers 6, 20 are used to support the yoke 8, it will be possible to appropriately establish the positional relation between the gap 12 and the coil 16 by the damper 6; or it may be designed, as indicated in FIG. 6, such that the flange 5 of a horizontal plate extending at the open edge of the frame 2 is integrally provided; a thick edge is given to the frame 3; a flat part 4 opposing the flange 5 is placed inside of said edge 3a; and the flange 5 and the flat part 4 face each other, with the frame 2 assembled inside of the edge of the frame 3.

In the present example an external magnet system is employed to constitute a magnetic circuit with a magnetic gap 12, but an internal magnet system in which the permanent magnet is set at the position of the pillar 9a may be employed.

In the present example the frames 2, 3 which constitute the casing 1 are designed dish-like in section, but the flat frames 2, 3 can have any sectional profile so long as the yoke 8 can be held in the casing 1 such that a relative displacement is permitted between the yoke 8 supported by the damper 6 and the casing 1.

Thus in the electromechanical vibration converter according to the present invention a yoke with a permanent magnet is supported in the casing at a position on a plane containing the gap formed by said yoke; therefore even if a load falls on the damper which supports the yoke, the relative displacement between the gap and the coil can be minimized; and accordingly the fitting position of the casing has no effect on the coil position, making it possible to convert the low-band audio signal to a vibration with fidelity.

Since the yoke is provided within the case in such a manner that a relative displacement between yoke and casing is permitted, the minimum necessary space for the yoke to displace in the casing will suffice. Moreover, since the casing itself is attached to the vibration plate, there is no need for erecting a screw stem as in the conventional practice and thus the converter as a whole can be made thin.

FIGS. 7~9 illustrate an embodiment of a device to drive the electromechanical vibration converter.

In FIG. 7, 21 denotes a mixer for mixing the audio signals from the right and left channels of the amplifier in a stereophonic device. To the output side of said mixer 21 is connected a low-pass filter 22 of the first stage. The cut-off frequency of said low-pass filter 22 is set at about 150 Hz.

To the output side of said low-pass filter 22 is connected a limiting amplifier 23 which acts such that the magnitude of the output can be limited to a specific value for an input of more than a specified magnitude. Thus said limiting amplifier 23 prevents the converter from being impressed with an excessive power.

25 denotes the low-pass filter of the second stage, which serves to eliminate an angle and correct a distortion of the audio signal cut off by the limiting amplifier, when its wave form becomes rectangular. The cut-off frequency of said low-pass filter 25 is set at about 150 Hz.

26 denotes a power amplifier to amplify a signal from the low-pass filter 25, the voltage gain being OdB.

FIG. 8 is a specified electric circuit diagram illustrating the block diagram of FIG. 7. In FIG. 8, the mixer 21 is composed of the resistors $R_1$, $R_2$ and the variable resistor VR. VR serves to adjust the output at the terminals a, b of the converter 24.

The low-pass filter $F_1$ is composed of the resistors $R_1$, $R_2$ and the condenser $C_1$.

The transister $Q_1$, the resistors $R_3 \sim R_7$ and the condensers $C_2$, $C_3$ constitute an amplifier 23 of voltage feedback type, $Q_1$ acting as a limiter at the supply voltage+B.

Meanwhile a low-pass filter $F_2$ is constituted by negative feedback from the condenser $C_2$ and these low-pass filters $F_1$, $F_2$ constitute the low-pass filter 22 of the first stage.

The resistors $R_8 \sim R_{10}$, the condensers $C_4 \sim C_6$ and the field effect transistor (FET) $Q_2$ constitute a low-pass filter 25 of the second stage.

The resistors $R_{12} \sim R_{16}$, the condenser $C_7$, the diodes $D_1$, $D_2$ and the transistors $Q_3 \sim Q_6$ constitute a power amplifier 26, which is a genuine complementary emitter-follower with a voltage gain OdB. The resistor $R_{11}$ is a boot strap type.

In this case, the signals from the right and left channels are blended into a single signal in the mixer 21 and only a low-frequency band signal can pass the low-pass filter 22. The passed signal is made an appropriate output signal for the electromechanical vibration converter by the limiting amplifier 23. Any distortion in the output waveform of the amplifier 23 can be corrected by the low-pass filter 25; and the output, after power-amplified by the amplifier 26, is supplied from the terminals a, b to the converter 24. Since the output is limited by the limiting amplifier 23 and the voltage gain at the amplifier 26 is OdB, not only the converter 24 but also the amplifiers 23, 26 are protected from impression with excessive power.

FIG. 9 illustrates a different embodiment of the present invention. Whereas in the preceding example the limiting amplifier 23 is adopted as the limiting means, in the present embodiment a limiter 27 is constituted by a diode; and in this stage, the necessary power for the amplifier 26 is secured by cutting off the output at a specific value without amplifying the input. The cut-off output from the limiter 27 is decided considering the mechanical strength of the converter 24.

In FIGS. 7 and 9 between the mixer 21 and the low-pass filter 22 or between the low-pass filter 22 and the limiting amplifier 23 or the limiter 27 there may be connected a delay circuit 28 so that a phase shift due to a separated arrangement of the speaker and the converter can be prevented.

As the result of the output from the amplifier of the stereophonic device being thus limited depending on the strength of the converter, not only the converter is protected from damage, but also the amplifier is protected from direct impression with the output from the exclusive amplifier for the stereophonic device. Further as the signal goes through two stages of low-pass filters, a distortion in the signal waveform can be corrected and no disagreeable sensation is caused.

What is claimed is:

1. Device to give an audio signal to a coil of a vibration converter and to generate a mechanical vibration in a casing thereof through magnetic interaction between the magnetic force developed in said coil and the magnetic force of a magnetic gap, said device comprising:

a mixer to blend the outputs from a stereo unit;

a first stage low-pass filter connected to said mixer to let pass a low-band audio signal for the converter;

a limiter means to limit the output of said low-pass filter when the output exceeds a specified level;

a second stage low-pass filter to correct a distortion of the wave form of a signal from said limiter means;

an amplifier connected to said low-pass filter, a delay circuit being added between the mixer and the low-pass filter.

2. Device of claim 1, wherein said limiter means is a limiting amplifier and said amplifier is a power amplifier.

3. Device of claim 1, wherein said limiter means is a diode.

* * * * *